US008925451B2

(12) United States Patent
Lanning et al.

(10) Patent No.: US 8,925,451 B2
(45) Date of Patent: Jan. 6, 2015

(54) ENGINEERED TOP INFEED HOPPER SYSTEM WITH SIDE-MOUNTED CUTTING DEVICE

(75) Inventors: Christopher J. Lanning, Federal Way, WA (US); David N. Lanning, Federal Way, WA (US)

(73) Assignee: Forest Concepts, LLC, Auburn, WA (US)

( * ) Notice: Subject to any disclaimer, the term of this patent is extended or adjusted under 35 U.S.C. 154(b) by 0 days.

(21) Appl. No.: 13/533,586

(22) Filed: Jun. 26, 2012

(65) Prior Publication Data

US 2012/0291640 A1 Nov. 22, 2012

Related U.S. Application Data

(63) Continuation-in-part of application No. 13/204,898, filed on Aug. 8, 2011, now Pat. No. 8,205,546, which is a continuation-in-part of application No. 12/584,810, filed on Sep. 11, 2009, now Pat. No. 7,992,491, which is a continuation-in-part of application No. 12/386,964, filed on Apr. 24, 2009.

(60) Provisional application No. 61/125,545, filed on Apr. 25, 2008.

(51) Int. Cl.
*B30B 9/30* (2006.01)

(52) U.S. Cl.
CPC ..... *B30B 9/301* (2013.01); *B30B 9/3078* (2013.01); *B30B 9/3032* (2013.01)
USPC ..... 100/215; 100/98 R; 100/188 R; 100/245

(58) Field of Classification Search
USPC ..... 100/7, 94, 95, 96, 97, 98 R, 70 A, 178, 100/179, 188 R, 215, 226, 240, 245
See application file for complete search history.

(56) References Cited

U.S. PATENT DOCUMENTS

| | | | | |
|---|---|---|---|---|
| 3,518,078 | A * | 6/1970 | Chazen | 75/414 |
| 3,805,689 | A | 4/1974 | Berger et al. | |
| 3,827,353 | A | 8/1974 | Isberg | |

(Continued)

FOREIGN PATENT DOCUMENTS

| | | | |
|---|---|---|---|
| WO | 89/10836 | A1 | 11/1989 |
| WO | 99/37474 | A1 | 7/1999 |
| WO | 03/031167 | A1 | 4/2003 |
| WO | 2007138165 | A1 | 12/2007 |

OTHER PUBLICATIONS

Stuart, W.B. and T.A. Walbridge, A new approach to harvesting, transporting, and storing logging residues, in: Hardwood Symposium Proceedings, 6th Annual Proceedings, The Business of Growing and Aging Hardwoods, Madison, WI. Forest Products Society, pp. 74-83, 1978.

(Continued)

*Primary Examiner* — Jimmy T Nguyen
(74) *Attorney, Agent, or Firm* — Thomas F. Broderick

(57) ABSTRACT

A baler for making compacted bales of a cellulosic biomass material, the baler comprising: a housing defining a compaction chamber therein, wherein the housing comprises a top wall, an infeed opening defined in the top wall for introducing the material into the compaction chamber, and wherein a cutting device is mounted on the housing alongside the infeed opening.

1 Claim, 12 Drawing Sheets

(56) References Cited

U.S. PATENT DOCUMENTS

| | | | | |
|---|---|---|---|---|
| 3,911,519 | A | 10/1975 | Anlas et al. | |
| 4,121,515 | A * | 10/1978 | Tea | 100/98 R |
| 4,125,068 | A * | 11/1978 | Linnerz et al. | 100/19 R |
| 4,377,362 | A | 3/1983 | Meinke | |
| 4,463,667 | A | 8/1984 | Jones | |
| 4,467,712 | A | 8/1984 | Fincham | |
| 4,487,120 | A | 12/1984 | Barstow | |
| 4,572,064 | A | 2/1986 | Burton | |
| 4,594,942 | A | 6/1986 | Denneboom | |
| 4,771,540 | A | 9/1988 | LaBounty | |
| 4,991,498 | A | 2/1991 | McCurdy | |
| 5,193,454 | A | 3/1993 | Bollegraaf | |
| 5,243,901 | A | 9/1993 | Green | |
| 6,189,443 | B1 | 2/2001 | Hilford | |
| 6,427,585 | B1 | 8/2002 | Brown et al. | |
| 6,779,570 | B2 | 8/2004 | Tardif | |
| 6,820,542 | B1 | 11/2004 | Truitt | |
| 7,752,960 | B2 | 7/2010 | Toor et al. | |
| 7,992,491 | B1 * | 8/2011 | Lanning et al. | 100/215 |
| 8,205,546 | B2 * | 6/2012 | Lanning et al. | 100/215 |
| 2005/0132667 | A1 | 6/2005 | McLeod et al. | |
| 2005/0145115 | A1 | 7/2005 | Garcia | |
| 2006/0086419 | A1 | 4/2006 | Aikins et al. | |
| 2007/0028787 | A1 * | 2/2007 | Olds | 100/240 |
| 2007/0157825 | A1 | 7/2007 | Miller | |
| 2008/0022865 | A1 * | 1/2008 | Newsome, III | 100/215 |
| 2009/0007537 | A1 | 1/2009 | Savoie et al. | |

OTHER PUBLICATIONS

Stuart, W.B, et al., Economics of modifying harvesting systems to recover energy wood, Forest Products Journal 31 (8):37-42, 1981.

Walbridge, T.A., and W.B. Stuart. 1981. An alternative to whole tree chipping for the recovery of logging residues. In Proceedings of the International Conference "Harvesting and Utilization of Wood for Energy Purposes" at Elmia, Jonkoping, Sweden. Sep. 20-30, 1980. Garpenberg, Sweden: Swedish University of Agricultural Sciences.

Schiess, P., and K. Yonaka; Baling—a new concept in residue handling; Proceedings, First Technical conference on Timber Harvesting in Central Rockies, Ft. Collins, 29 pages, Jan. 4-6, 1983; pp. i-iii and 1-26.

Schiess, P., and W.E. Stuart; Baling of whole trees and/or residue as an alternative to in-woods chipping and/or residue treatment; Final Report submitted to Pacific Northwest Forest and Range Experimental Station, Seattle, WA, Jun. 1, 1983; pp. i-iii and 1-87.

Schiess, P., and K. Yonaka; Evaluation of industrial baling techniques for forest residue; Final Report to Department of Natural Resources, Olympia, WA, Jun. 30, 1983; pp. i-iv and 1-67.

Guimier, D.Y. 1985. Evaluation of forest biomass compaction systems. Special Report No. SR-30. ENFOR Project P-313. Pointe Claire, Canada: Forest Engineering Research Institute of Canada; pp. i-vii and 1-62, Aug. 1985.

Pottie, M.A., and D.L. Guimier, Harvesting and transport of logging residuals and residues, FERIC Special Report No. SR-33, IEA Cooperative Project No. CPC6, pp. i-vii and 1-62, May 1986.

Fridley, J.L., and T.H. Burkhardt, Densifying forest biomass into large round bales, Transactions of the ASAE 27(5):1277-1281, 1984.

John Deere 1490D Energy Wood Harvester, or "Bundler" www.deere.com/en_US/cfd/forestry/deere_forestry/harvesters/whee1/1490d_general.html Accessed Feb. 23, 2009.

Supertrak WB55 Biobaler https://www.timberbuysell.com/Community/DisplayAd.asp?id=2686 Accessed Nov. 7, 2008.

Dooley, J.H., M.S. DeTray, and D.N. Lanning. Mar. 2006. Technology to enable utilization of biomass from wildland-urban interface fuels reduction projects. Phase II: Field evaluation of baling vs. chipping. Auburn, WA: Forest Concepts, LLC.

Dooley, J.H., M.S. DeTray, D.N. Lanning, J.L. Fridley; Utilization of biomass from WUI fuels reduction: Biomass collection and handling from wildland-urban intermix projects on residential and suburban properties; Poster presented at SmallWood 2006, Richmond, VA, May 16, 2006.

Dooley, J.H., J.L. Fridley, D.N. Lanning. M.S. DeTray; Large rectangular bales for woody biomass; Paper No. 068054, presented at the 2007 ASABE Annual International Meeting, Portland, OR, Jul. 9-12, 2006.

Dooley, J.H., D.N. Lanning, C. Lanning, and M.S. DeTray; Transportation of biomass from wildland urban intermix (WUI): Biomass preprocessing and handling to reduce cost of transportation and add value; poster presented at Intermountain Roundwood Association Annual Meeting, Missoula, MT, 2007.

Lanning, D.N., J.H. Dooley, M.C. DeTray, and C.N. Lanning; Engineering factors for biomass baler design; ASABE Paper No. 078047, presented at the 2007 ASABE Annual International Meeting, Minneapolis, MI, Jun. 17-20, 2007.

Lanning, D., C. Lanning, J. Dooley, M. DeTray, T. Aristidou; Baling to improve transport of biomass from urban areas; poster presented at the Forest Innovation Conference, Missoula, MT, Apr. 25, 2008.

Dooley, J.H., D. Lanning, C. Lanning, J. Fridley; Biomass baling into large square bales for efficient transport, storage, and handling; paper presented at the Council on Forest Engineering 2008: 31st Annual Meeting, Charleston, SC, Jun. 22-25, 2008.

Van Pelt et al., Maize, soybean, and alfalfa biomass densification, Agricultural Engineering International: the CIGR Journal of Scientific Research and Development, Manuscript EE 03 002, May 2003.

Beach, J. E., et al., The design and analysis of an infeed system for forest residue baler. Transactions of the ASAE, 28 (5)-1354-1357, 1985.

* cited by examiner

ENGINEERED TOP INFEED HOPPER SYSTEM WITH SIDE-MOUNTED CUTTING DEVICE

STATEMENT OF GOVERNMENT LICENSE RIGHTS

This invention was made with government support by the CSREES Small Business Innovation Research program of the U.S. Department of Agriculture, grant numbers 2005-33610-15483 and 2006-33610-17595. The government has certain rights in the invention.

FIELD OF THE INVENTION

Our invention relates to harvesters, particularly balers, and provides a top infeed hopper system engineered to receive and direct cellulosic and particularly woody biomass materials into a baling chamber.

BACKGROUND OF THE INVENTION

In 1978 forestry researchers at Virginia Polytechnic Institute (VPI) conducted field tests using a hay baler powered by the hydraulics of a knuckle-boom loader and concluded that baling offers considerable cost and operational advantages as a method of recovering forest residues for either fiber or fuel (1; see the appended Citations).

The VPI researchers then built and tested a prototype in-woods logging residue baler (2-7). Following testing of the VPI prototype baler in the North Western U.S.A. in the early 1980's, several design modifications were suggested for a "second generation" baler (8-9), including the need for a top infeed to allow processing of small size material (See (8) at pp. 29-30).

Various biomass bundlers and balers have been proposed in the patent literature (10). Presently the only commercial systems are a bundler, the John Deere 1490D Energy Wood Harvester (11), and a round baler, the SuperTrak WB55 Biobaler™ (12).

Particularly relevant to the present invention are the open top finger baler disclosures of Risoda Pty. Limited (13).

The present inventors have reported their progress under a federal contract from the USDA CSREES SBIR program to develop better methods to collect and transport woody biomass (14-20). Our goal has been to engineer more efficient recovery and transport of woody biomass to second-generation bioenergy and biofuel plants.

SUMMARY OF THE INVENTION

Here we describe an infeed hopper system suitable for receiving and directing cellulosic biomass materials into a baling chamber situated below the hopper. Our invention provides a baler for making compacted bales of a cellulosic and preferably woody biomass material, the baler comprising: a housing defining a compaction chamber therein, wherein the housing comprises a top wall, an infeed opening defined in the top wall for introducing the material into the compaction chamber, and a hopper system comprising: first and second doors pivotably attached to the housing in opposing array over the infeed opening, wherein each door comprises a pivot having a plurality of fingers extending in planar array therefrom and defining a plurality of recesses disposed therebetween, and wherein the fingers of the first and second doors are staggered such that the fingers of each door are positioned opposite to and receivable by the recesses of the other door, and actuator means for pivoting the doors upwardly to form a chute for directing the material toward the infeed opening, and downwardly to intermesh and preferably interlock the fingers and substantially cover the infeed opening.

DETAILED DESCRIPTION OF THE PREFERRED EMBODIMENT

Figure 1:
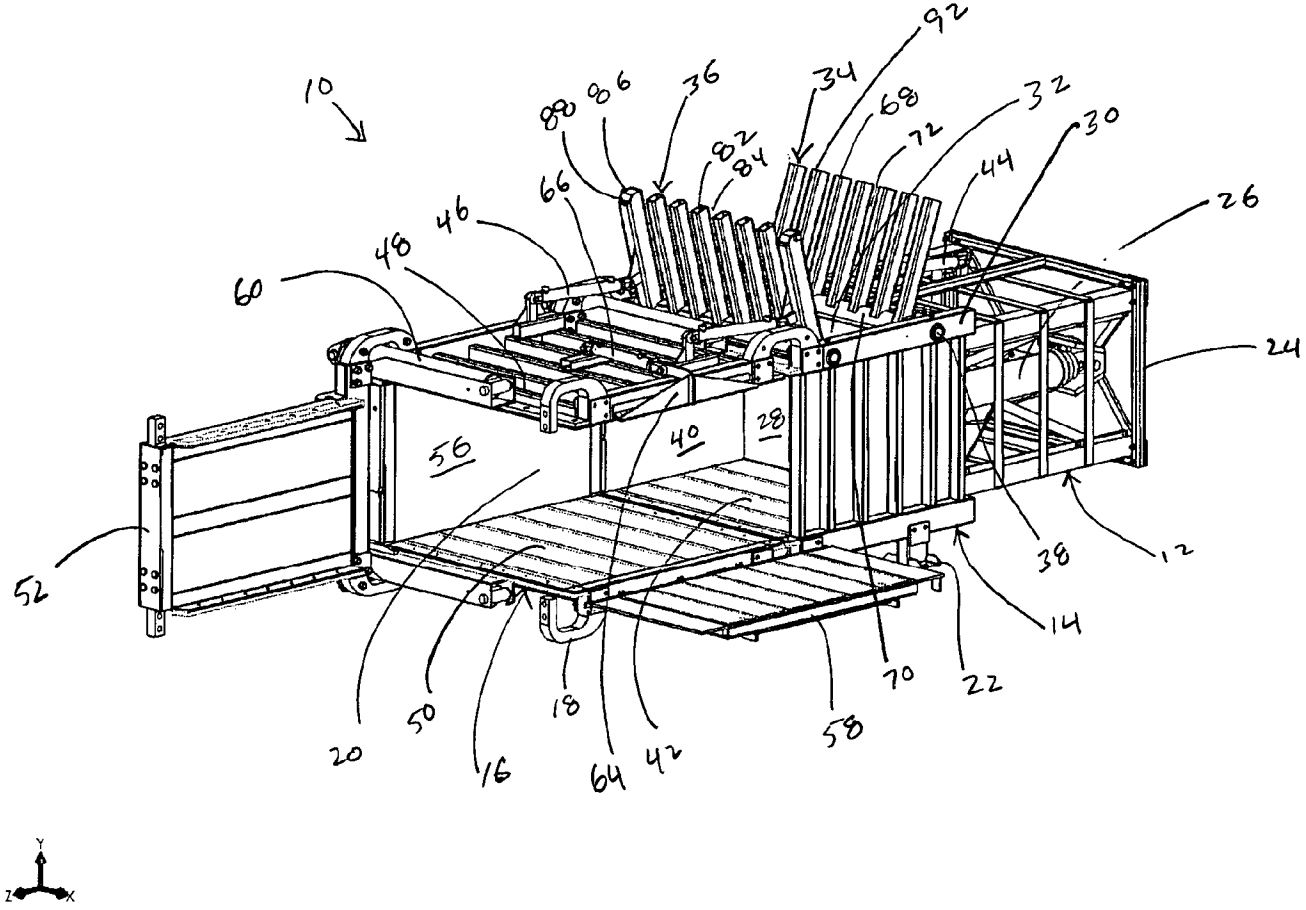
FIG. 1 is an elevated view of a representative biomass baler with open hopper doors.

We have applied engineering design principles to the long-felt need of providing a top infeed system for cellulosic and particularly woody biomass balers.

The term "cellulosic biomass" as used herein refers generally to encompass all plant materials harvested by baling for use as industrial feedstocks, including woody biomass, energy crops like switchgrass, miscanthus, and hemp, and agricultural crop residues including corn stover.

The term "woody biomass" as used herein refers to all parts of trees, shrubs and woody plants useable as industrial feedstocks for fiber, bioenergy, and biofuels, including timber harvest residues and land clearing debris, small-diameter trees, shrubs and brush, dedicated energy crops like willow and poplar, tree service prunings, and residential green waste.

The following Table lists the reference numerals used in the description of the currently preferred embodiment that is shown in the FIGURES.

| | |
|---|---|
| 10 | baler |
| 12 | platen assembly |
| 14 | infeed chamber assembly |
| 16 | compaction chamber assembly |
| 18 | connector |
| 20 | baling chamber |
| 22 | foot |
| 24 | framework, platen assembly |
| 26 | hydraulic cylinder, compression |
| 28 | platen, compression |
| 30 | framework, upper infeed chamber assembly |
| 32 | infeed opening |
| 34 | hopper door, front |
| 36 | hopper door, rear |
| 38 | hinge pin |
| 40 | side wall, infeed chamber assembly |
| 42 | floor plate, infeed chamber assembly |

-continued

| | |
|---|---|
| 44 | cylinder, front hopper door |
| 46 | cylinder, rear hopper door |
| 48 | upper wall, compression chamber assembly |
| 50 | lower wall, compression chamber assembly |
| 52 | door, contingency |
| 54 | hinge |
| 56 | platen, ejection |
| 58 | door, discharge |
| 60 | hydraulic cylinder, ejection |
| 62 | hydraulic cylinder, discharge |
| 64 | door latch |
| 66 | hydraulic cylinder, door latch |
| 68 | finger, front door |
| 70 | pivot, front door |
| 72 | recess, front door |
| 74 | bracket, front door |
| 76 | gusset, front door |
| 78 | latch bar, front door |
| 80 | pivot, rear door |
| 82 | finger, rear door |
| 84 | recess, rear door |
| 86 | latch finger, rear door |
| 88 | notch |
| 90 | internal stop |
| 92 | external stop |
| 94 | bracket, rear door |
| 96 | gusset, rear door |
| 98 | shear bar |
| 100 | gap |
| 102 | cutting device |
| 104 | chain-type saw |
| 106 | tooth |
| 108 | tool bar |
| 110 | housing |
| 112 | actuator |
| 114 | drive motor |
| 116 | shear bar |
| 118 | shear bar |
| 120 | pivot |
| 122 | mounting block |
| 124 | actuator |
| 126 | actuator |
| 128 | shear bar |
| 130 | mounting block |
| 132 | track |
| 136 | anvil |

FIG. 1 shows a representative biomass baler 10 that we designed and constructed under the aforementioned Department of Agriculture grant. The baler 10 receives woody and other cellulosic biomass materials, compacts the biomass materials into parallelepiped bales, and discharges the bales. The baler 10 is preferably constructed of three separate modules, a platen assembly 12, an infeed chamber assembly 14, and a compaction chamber assembly 16, that are bolted together by metal connectors 18. The infeed chamber assembly 14 is in open communication with the compaction chamber assembly 16 and together house a baling chamber 20. Modular construction makes it convenient to repair or replace failed components, or replace the compaction chamber assembly 16 with alternative modules configured to produce shorter or longer bales. Also shown is one of four steel feet 22 by which the baler 10 can be bolted to, e.g., a trailer bed (not shown) or framework for stationary use.

Nomenclature with respect to the baler 10 shown in the FIGURES: toward the platen assembly 12 is referred to herein for illustrative purposes as "front", and toward the compaction chamber assembly 16 as "rear".

The platen assembly 12 has a welded steel framework 24 that anchors and supports two telescoping hydraulic cylinders 26 (three-stage: 6, 5, and 4 inches) that attach to and move a compression platen 28 reciprocally through the baling chamber 20.

When fully retracted (as shown in this view) the compression platen 28 forms the front wall of the infeed chamber assembly 14. The infeed chamber assembly 14 has an upper framework 30 that demarcates a large rectangular infeed opening 32. A pair of closeable hopper doors 34, 36 is mounted in opposing array over the infeed opening 32. Each of the doors 34, 36 is pivotally connected to the framework 30 by a hinge pin 38. When raised (as shown here), the hopper doors 34, 36 create an open chute through which a grapple loader (not shown) can drop and push biomass materials through the infeed opening 32 into the baling chamber 20. When closed (see FIGS. 2 and 6), the hopper doors 34, 36 intermesh and preferably interlock together in horizontal planar array so as to substantially close the infeed opening 32 and thereby form an upper wall of the infeed chamber assembly 14 without obstructing transit of the compression platen 28.

The infeed chamber assembly 14 also has two side walls 40 and a floor plate 42 that, together with the retracted compression platen 28 and the upper framework 30 with closed hopper doors 34, 36 define the front end or infeed compartment of the baling chamber 20. Construction and operation of the hopper doors 34, 36 is discussed in detail below. Shown here is a single 2" hydraulic cylinder 44 that moves the front hopper door 34, and two 2" hydraulic cylinders 46 that move the rear hopper door 36.

The compaction chamber assembly 16 houses the rear end or compression compartment of the baling chamber 20. The compaction chamber assembly 16 has fixed upper and lower walls 48, 50. The rear wall or end cap is configured as a contingency door 52 (shown open) that is mounted on lateral hinges 54. The contingency door 52 is bolted shut during the baling process but can be manually opened, if need be, to remove defective bales from the baling chamber 20; and for this purpose the compression hydraulic cylinders 26 are configured to push the compression platen 28 at least the entire length of the compaction chamber assembly 16.

An ejection platen 56 and a discharge door 58 form the sidewalls of the compaction chamber assembly 16. When bale formation is completed, the discharge door 58 is cantilevered downward into a horizontal platform (as shown in this view). Two pairs of telescopic hydraulic cylinders 60 (two stage: 4 and 3 inches) then move the ejection platen 56 to push the bale across the compaction chamber assembly 16 and onto the opened discharge door 58.

Figure 2:
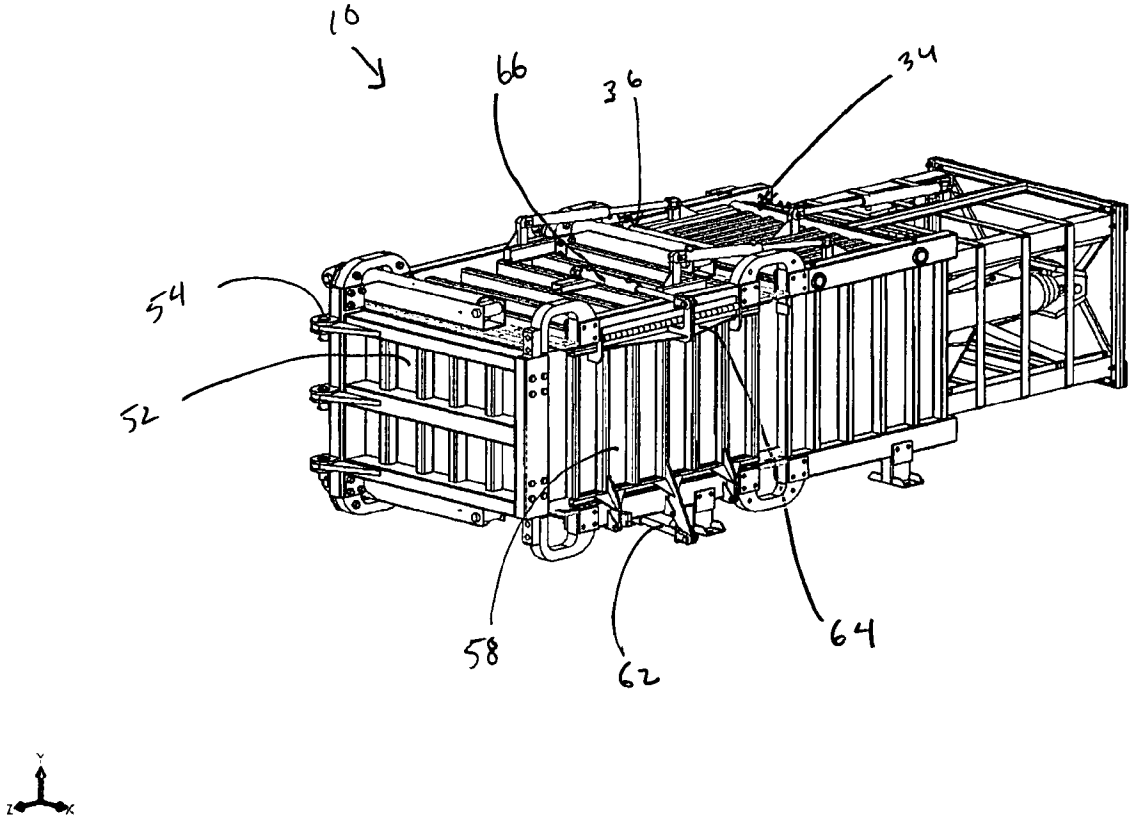
FIG. 2 shows the baler of FIG. 1 with closed hopper doors.

FIG. 2 shows the baler 10 with the hopper doors 34, 36, contingency door 52, and side discharge door 58 in the closed positions. Shown also is a 2" hydraulic cylinder 62 that lowers and raises the discharge door 58, which is secured closed by a hinged upper door latch 64 that is controlled by a 2" hydraulic cylinder 66.

Figure 3:
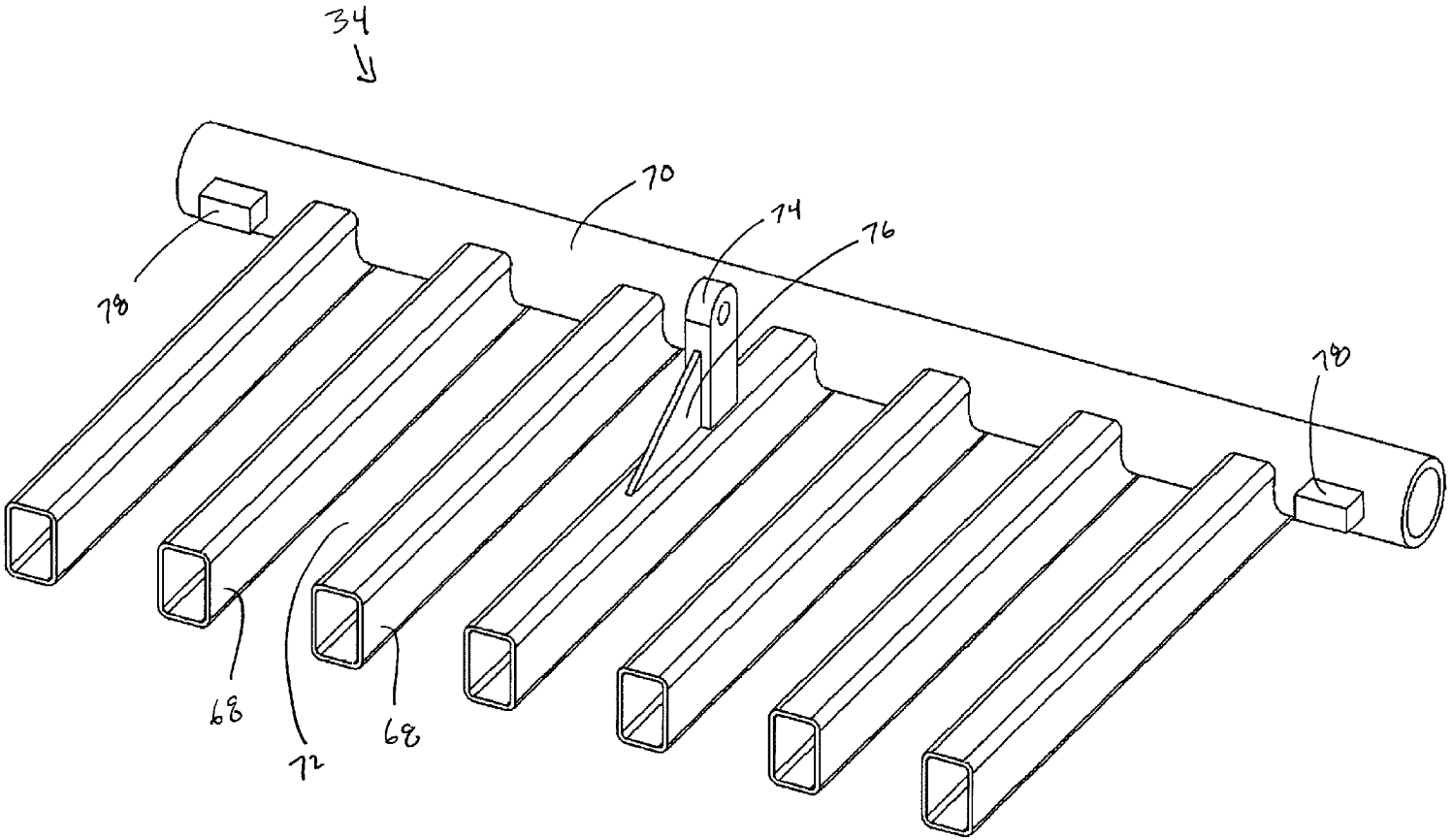
FIG. 3 is an isolated view of the front hopper door.

FIG. 3 is an isolated view of the front hopper door 34. In this illustrative embodiment, seven fingers 68 of rectangular steel tube are welded in parallel array to a pivot 70 of rounded steel tube, which houses one of the hinge pins 38. The fingers 68 are positioned along the pivot 70 to create a plurality of recesses 72 therebetween. A bracket 74 with supporting gusset 76 on the upper surface of one of the fingers 68 provides an attachment point for the hydraulic cylinder 44. A pair of latch bars 78 is welded to the pivot 70 in the same plane as the fingers 68 and near the outermost ends of the pivot 70.

Figure 4:
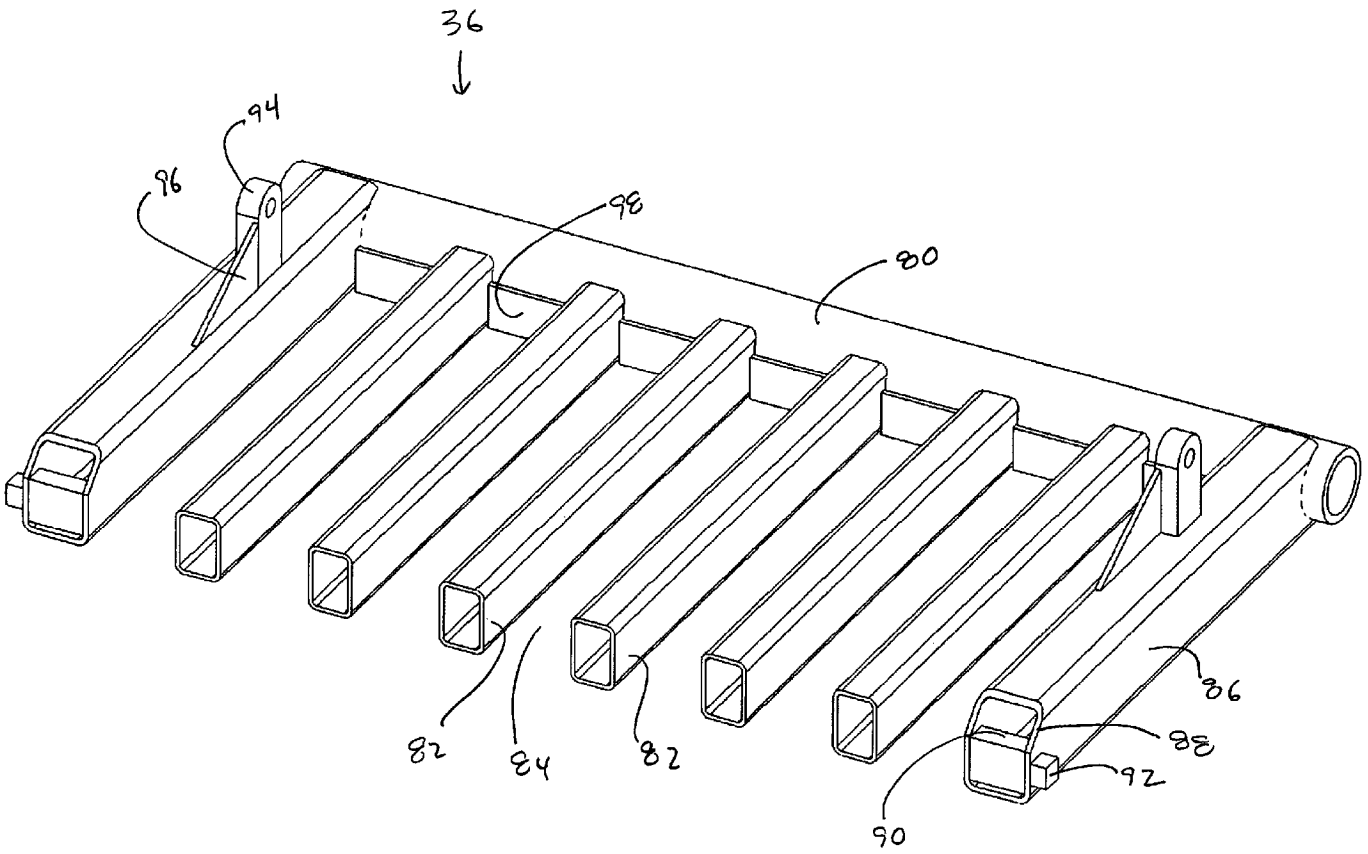
FIG. 4 is an isolated view of the rear hopper door.
Figure 5:
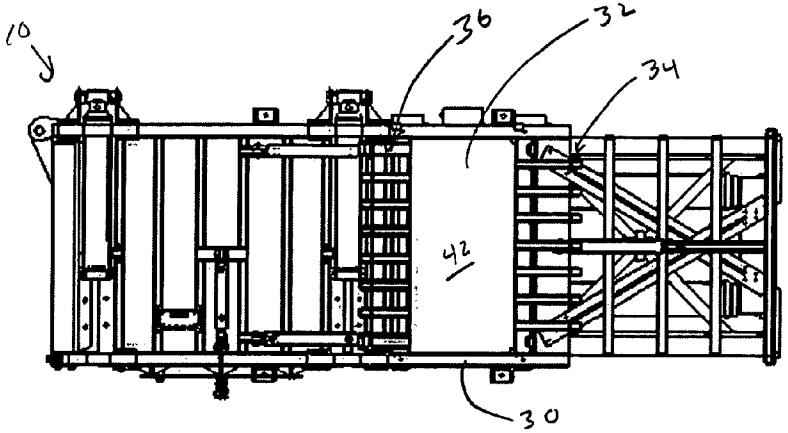
FIG. 5 is a top view of the baler of FIG. 1 with open hopper doors.

FIG. 4 shows the corresponding rear hopper door 36, which also has a pivot 80 with in this embodiment six tubular fingers 82 forming a planar array of interposed recesses 84. Notably, these fingers 82 are staggered in position with respect to the fingers 68 of the opposing front hopper door 34 such that the fingers of each door are positioned opposite to and receivable by the recesses of the other door (as shown in FIG. 5). Preferably the pivot 80 is provided with an outermost pair of latch fingers 86 that are sized and positioned to receive and contain the latch bars 78 on the opposing front hopper door 34, in order to interlock the doors 34, 36 in a horizontal closed position over the infeed opening 32. For that purpose the latch fingers 86 are provided with a notch 88 and an internal stop 90. The notch 88 receives the pivoting latch bar 78 against the internal stop 90 as the doors 34, 36 approach and reach the fully closed position. The outer sides of the latch fingers 86 are provided with external stop bars 92 that help position the rear hopper door 36 (and the closed, intermeshed doors 34, 36) within the framework 30 surrounding the infeed opening 32. The rear hopper door 36 also has a pair of brackets 94, with supporting gussets 96, which serve as attachment sites for the hydraulic cylinders 46. Preferably the rear hopper door 36 is also provided with shear bars 98 that are mounted on the pivot 80 within the recesses 84 between the fingers 68, 86.

FIG. 5 is a top view of the baler 10 showing the hopper doors 34, 36 in the raised and chute-forming positions to guide biomass materials through the uncovered infeed opening 32 into the baling chamber 20. The hopper door pivots 70, 80 are preferably aligned parallel to the compression platen 28.

Figure 6:
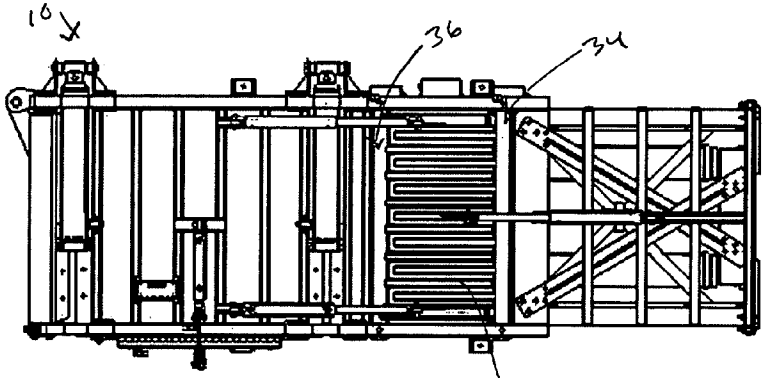
FIG. 6 shows the baler of FIG. 5 with closed hopper doors.

FIG. 6 is a top view of the baler 10 showing the hopper doors 34, 36 in the closed and locked position.

Figure 7A:
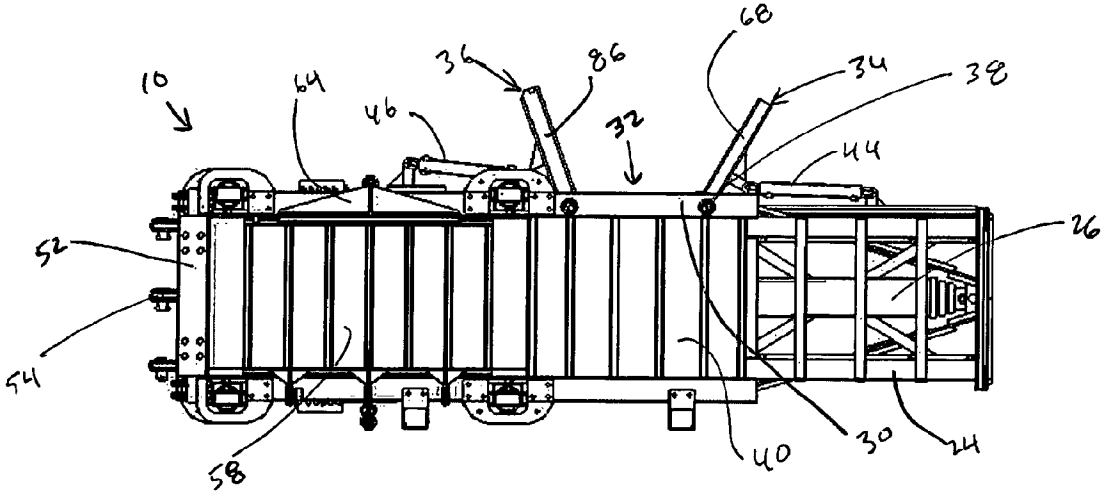
FIGS. 7A-7D depict a representative sequence for closing the hopper doors.
Figure 7B:
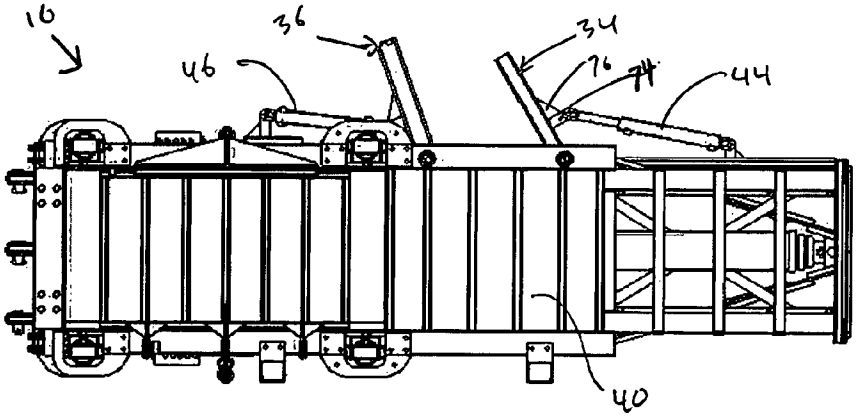
Figure 7C:
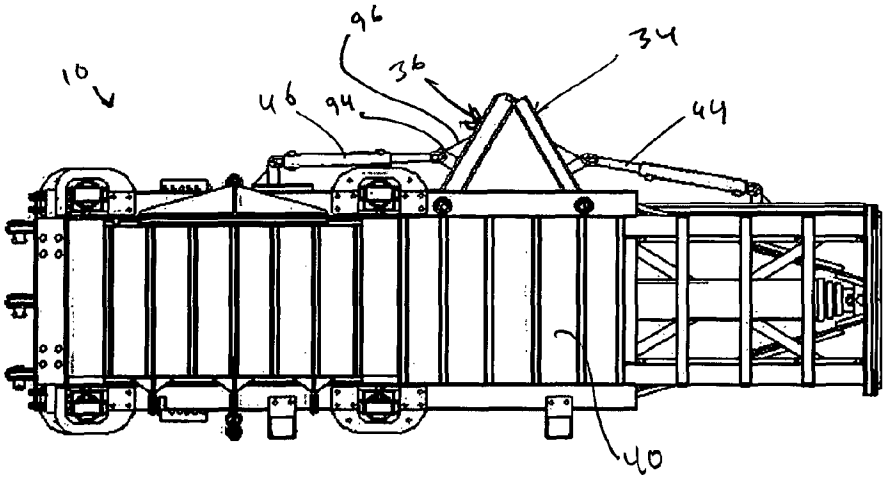

FIGS. 7A-7D are side views of the baler 10 showing a representative sequence for closing the hopper doors 34, 36. FIG. 7A shows the hopper doors 34, 36 in the raised positions. We have found that for loading woody biomass or switchgrass the front and rear hopper doors 34, 36 are preferably pivoted to positions about 120° and 105°, respectively, above the framework 30. When the infeed chamber assembly 14 has been loaded with biomass materials, the front hopper door 34 is partially closed to a position about 55° above the framework 30, as shown in FIG. 7B. This pivoting movement of the front hopper door 34 sweeps any overflowing biomass material toward the rear hopper door 36. The rear hopper door 36 is pivoted to a position about 45° closed, which sweeps the material against the front hopper door 34 and entraps the material under the arched hopper doors 34, 36, as shown FIG. 7C. These pivoting movements may be coordinated to be concurrent, at appropriate cylinder velocities, or sequenced stepwise.

Figure 7D:
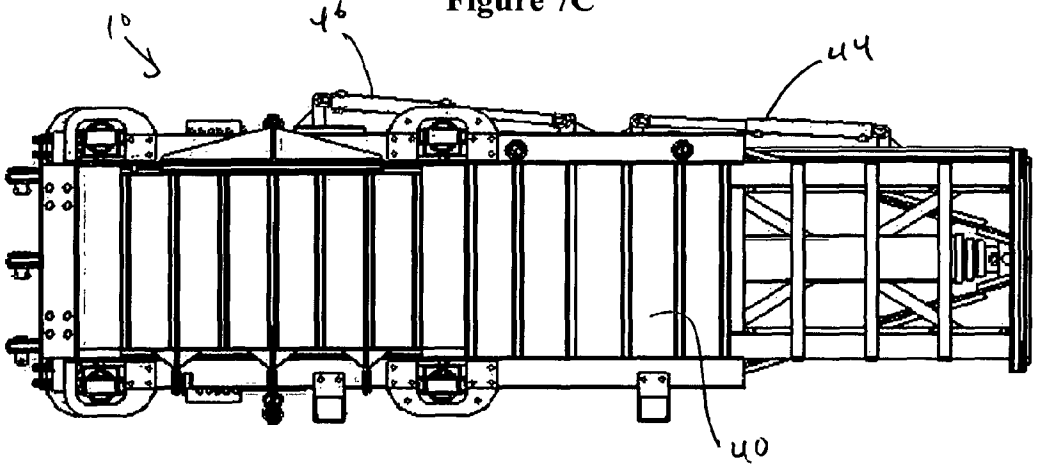

The hopper doors 34, 36 are then pivoted concurrently into full horizontal closure (FIG. 7D). These closing movements are coordinated so that the rear hopper door 36 reaches horizontal first, thereby presenting its notched latch fingers 86 for engagement by the door latches 64 on the first hopper door 34.

As the overlapping hopper doors 34, 36 press the overflowing biomass material downward through the infeed opening 32, there is an opportunity for some of the material to become entrapped between the fingers 68, 82, 86 and within the closing recesses 72, 84. We have found that configuring the hopper doors 34, 36 so that about a one inch gap 100 of recess space 72, 84 remains between the fully intermeshed fingers 68, 82, 86 is suitable for woody biomass materials like arborist tree trimmings. Any such materials that become entrapped between the framework 30 and the outer latch bars 78 or the rear pivot 80 tend to be pulled into the baling chamber 20 as the compression platen 28 advances, and any materials entrapped between the front pivot 70 and the frame 30 are pushed and broken off against the rear shear bars 98. For forestry applications the latch fingers 86 can additionally be provided with edged shear bars, knives, or slashing saws (not shown), as can any of the fingers 68, 82.

In an alternative embodiment, a cutting device 102 such as a saw or shear is mounted on one (or both) of the upper frameworks 30 of the infeed chamber assembly 14, alongside the infeed opening 32. The cutting device 102 is used to sever and cut off the ends of bunched biomass, e.g., as held and positioned by a grapple claw (not shown) and/or hopper doors (as described below), in order to shorten the bundle and thereby facilitate loading through the infeed opening 32.

Figure 8:
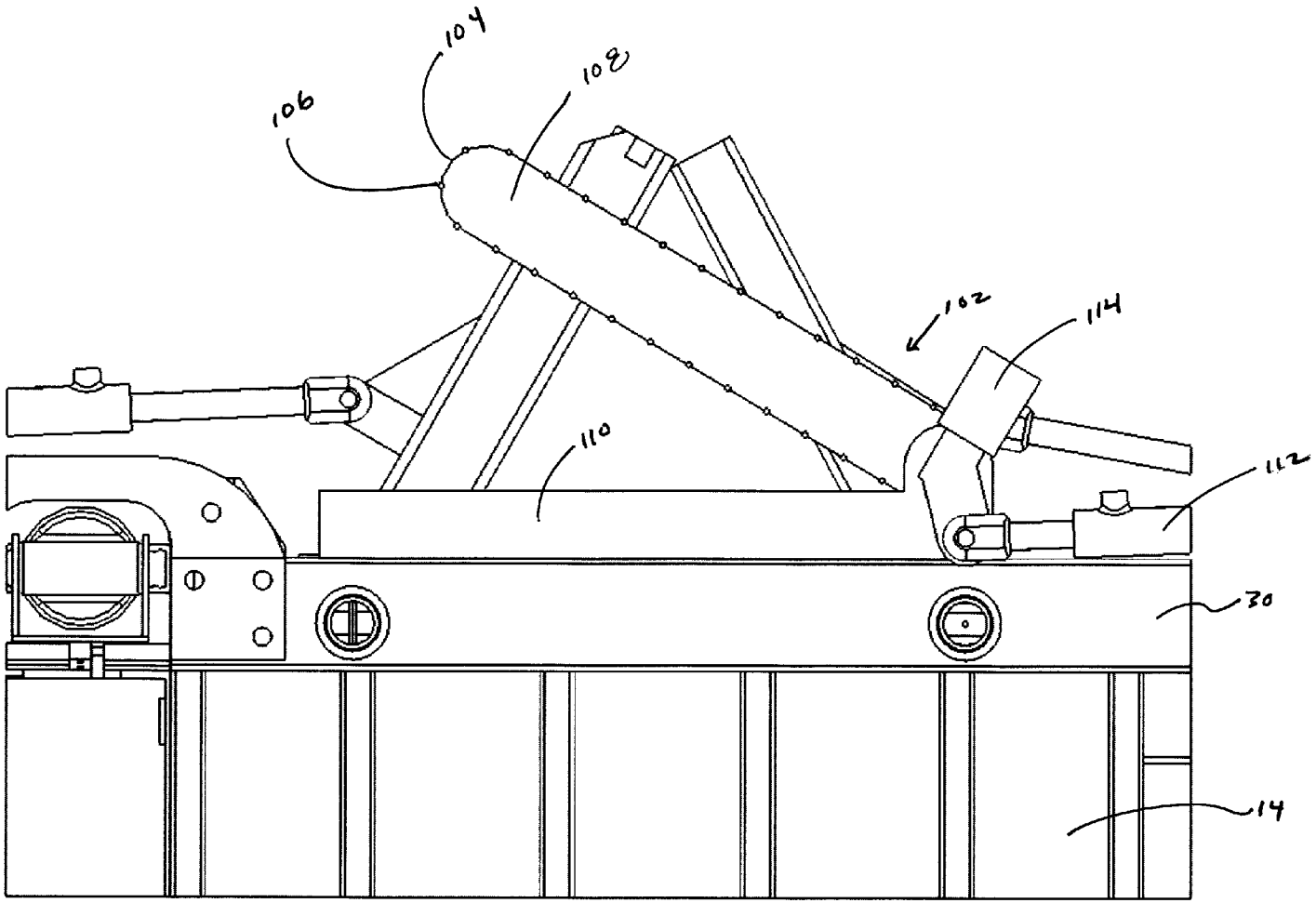
FIG. 8 shows a side-mounted cutting device configured as a chain-type saw.

FIG. 8 shows an exemplary cutting device 102 configured as a chain-type saw 104 with spaced projecting teeth 106 moveably carried along the periphery of a tool bar 108. The tool bar 108 is pivotally mounted on housing 110 that acts as a bypass anvil when the bar 108 and saw 104 are pivoted by a hydraulic or electric actuator 112 from an activated upright position to a through-cut horizontal position. In use, the distal ends of a grapple-load of biomass are positioned on the housing 110 and across the infeed opening 32, and held there by pivoting the hopper doors 34, 36 to about 45° closed (as shown in FIGURE &C). The saw 104 is then activated by a drive motor 114 and pivoted downward to cut the biomass so that the cut ends fall through the infeed opening 32. The hopper doors 34, 36 can then be opened, and the grapple claw lifted and spun around to present the other end of the bundle to the cutting sequence. In this manner the residual bundle has been sized for convenient and efficient loading.

Figure 9:
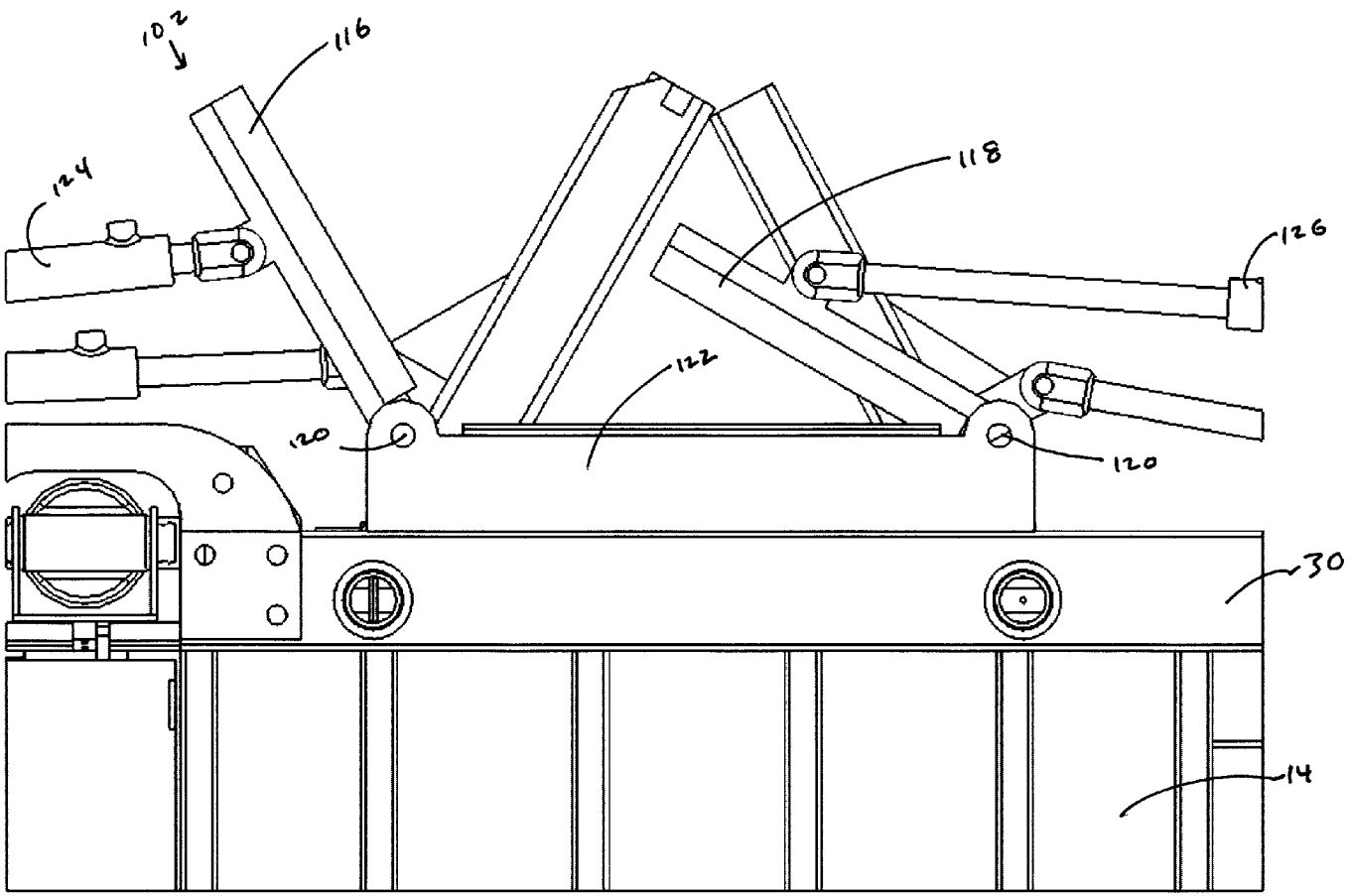
FIG. 9 shows a side-mounted cutting device with opposing shear bars.
Figure 10:
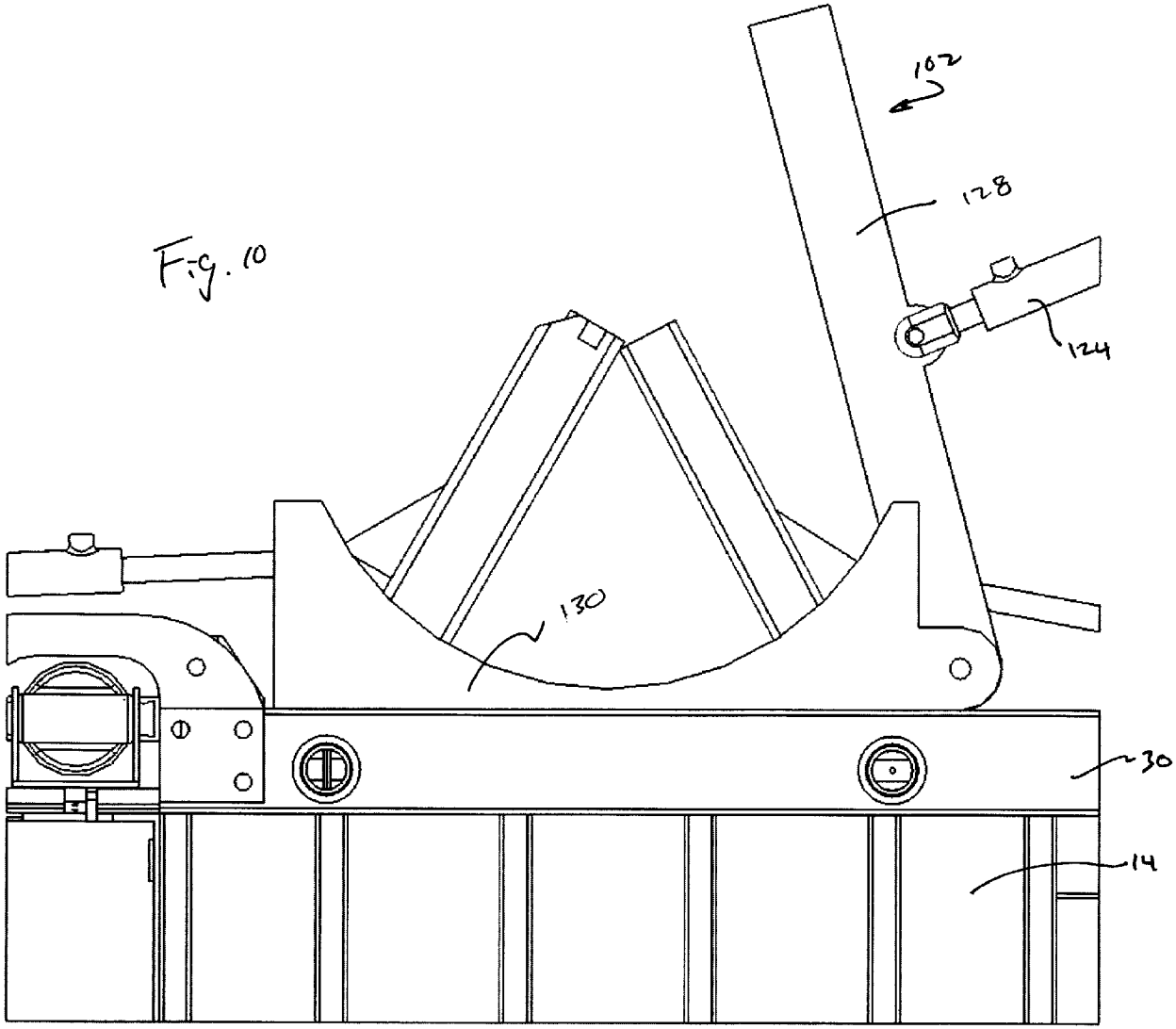
FIG. 10 shows a side-mounted cutting device with a shear bar and bypass anvil.

FIG. 9 shows an alternative embodiment wherein the cutting device 102 has two opposing shear bars 116, 118 that are connected by pivots 120 to an underling shear mount block 122. Actuators 124, 126 pivot the bars 116, 118 downward in overlapping arcs to shear entrapped biomass much as described above. FIG. 10 shows a related embodiment having a single shear bar 128 with a mount block 130 configured as a bypass anvil.

Figure 11:
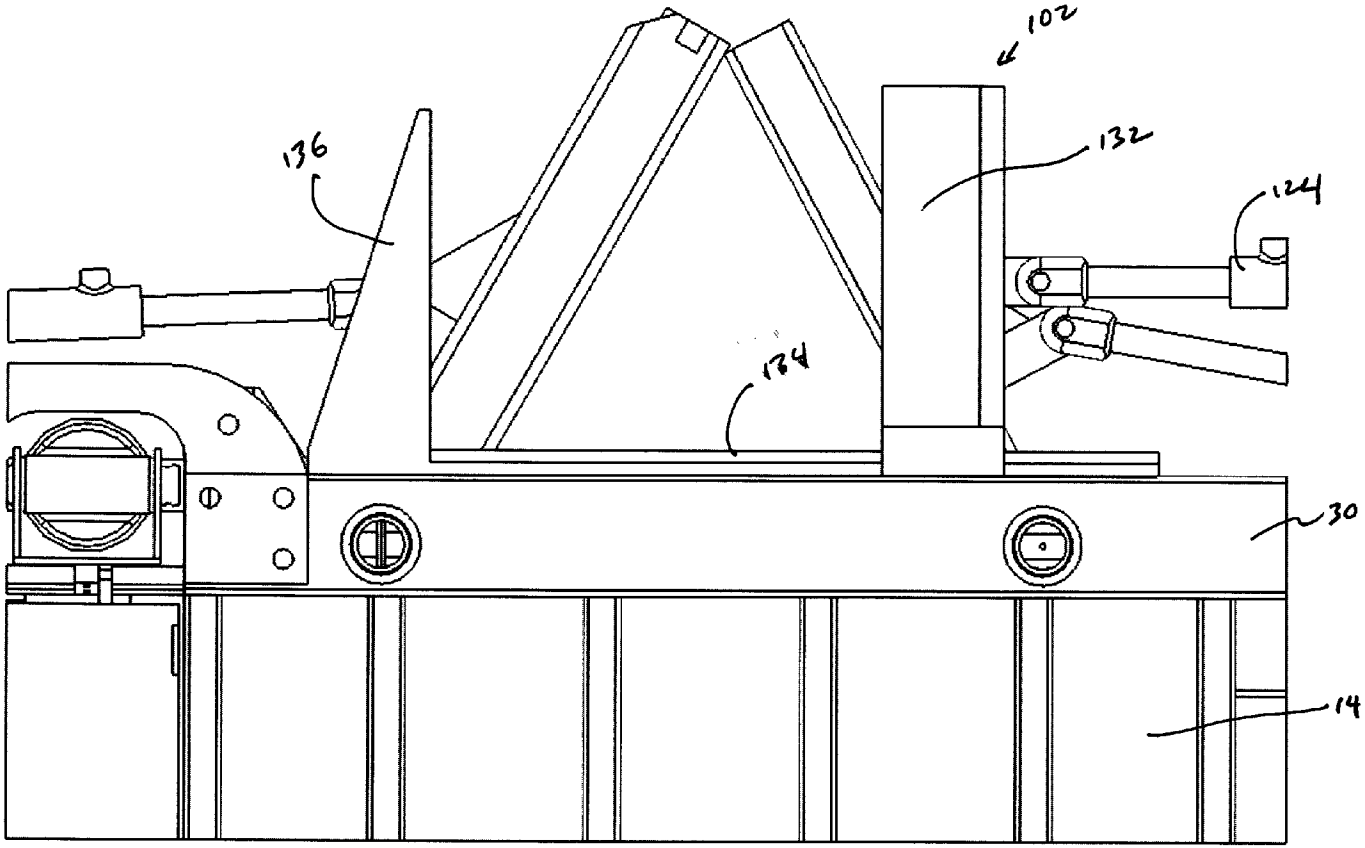
FIG. 11 shows a side-mounted cutting device configured as a sliding wedge.

In another embodiment, shown in FIG. 11, the cutting device 102 is configured as a wedge 132 that slides along a mount track 134 against a fixed (or moveable) anvil 136.

EXAMPLE

Following bill of materials is for the hopper door assembly shown in the FIGURES, sized for an infeed opening 32 measuring 48" wide×30" long.

| REF # | PART NAME | DESCRIPTION |
|---|---|---|
| 34 | | Front hopper door |
| 70 | Pivot | 3.25" × 0.375" × 48" tube |
| 68 | Fingers (7) | 2" × 3" × 3/16" × 24" tube |
| 74 | Bracket (1) | 1" × 2" × 5.125" bar, 1" radius |
| 76 | Gusset (1) | 1/4" × 3" × 5.2" plate |
| 78 | Latch bars (2) | 1" × 1.25" × 2" bar |
| 44 | Hydraulic (1) | 2" dual acting cylinder × 16"; 3000 psi |
| 36 | | Rear hopper door |
| 80 | Pivot (1) | 3.25" × 0.375" × 48" tube |
| 82 | Fingers (6) | 2" × 3" × 3/16" × 25" tube |
| 86 | Latch fingers (2) | 3" × 4" × 1/4" × 25" tube |
| 94 | Brackets (2) | 1" × 2.5" × 4.25" bar |
| 96 | Gussets (2) | 1/4" × 3" × 5.2" plate |
| 98 | Shear bars (6) | 2" × 2" × 1/4" × 4" angle |
| 90 | Internal stops (2) | 1" × 1.625" × 2.5" bar |
| 92 | External stops (2) | 3/4" × 1" × 1" bar |
| 46 | Hydraulics (2) | 2" dual acting cylinder × 16"; 3000 psi |
| 38 | Hinge pins (2) | 2" schedule 80 steel pipe × 55" |

Figure 12:
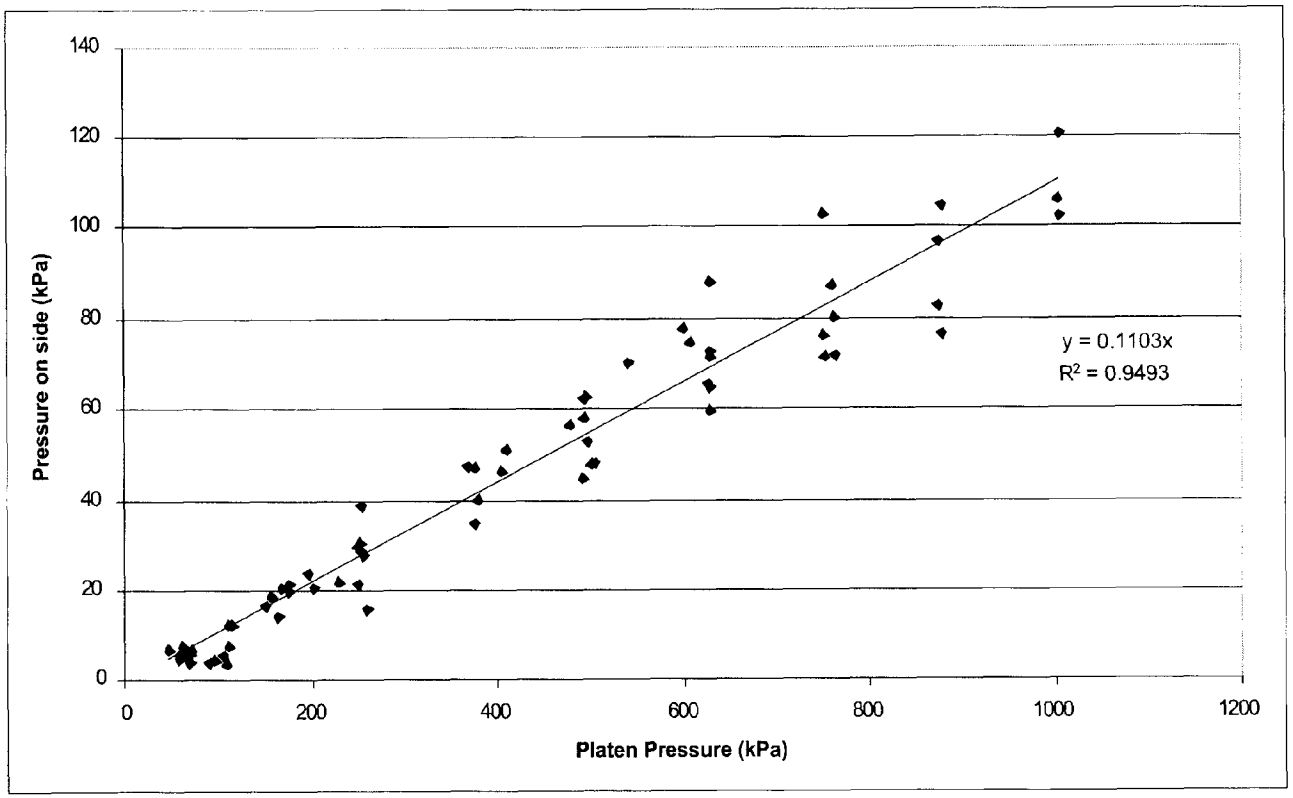
FIG. 12 is a pressure ratio graph.

FIG. 12 is a pressure ratio graph. Each data point represents a peak pressure reached while making a single flake of a bale of WoodStraw® in a bench top baler. This is a compellation of 13 bales made at different compression pressures. From the axial pressure to side pressure ratio trend observed in those experiments we estimate v=0.11 (the pressure ratio coefficient analogous to Poisson's ratio for homogeneous solids).

CITATIONS

The contents of each of the following publications are incorporated in their entireties by reference herein.

(1) Stuart, W. B. and T. A. Walbridge, A new approach to harvesting, transporting, and storing logging residues, in: Hardwood Symposium Proceedings, 6th Annual Proceedings, The Business of Growing and Aging Hardwoods, Madison, Wis. Forest Products Society, pp. 74-83, 1978.

(2) Stuart, W. B, et al., Economics of modifying harvesting systems to recover energy wood, Forest Products Journal 31(8):37-42, 1981.

(3) Walbridge, T. A., and W. B. Stuart. 1981. An alternative to whole tree chipping for the recovery of logging residues. In Proceedings of the International Conference "Harvesting and Utilization of Wood for Energy Purposes" at Elmia, Jonkoping, Sweden. Sep. 20-30, 1980. Garpenberg, Sweden: Swedish University of Agricultural Sciences.

(4) Schiess, P., and K. Yonaka. 1982. Evaluation of new concepts in biomass fiber transport. In Progress in Biomass Conversion, Vol. III., edited by K. V. Sarkanen, D. A. Tillman and E. C. Jahn. New York: Academic Press.

(5) Schiess, P., and K. Yonaka; Baling—a new concept in residue handling; Proceedings, First Technical conference on Timber Harvesting in Central Rockies, Ft. Collins, 29 pages, Jan. 4-6, 1983; pp. i-iii and 1-26.

(6) Schiess, P., and W. E. Stuart; Baling of whole trees and/or residue as an alternative to in-woods chipping and/or residue treatment; Final Report submitted to Pacific Northwest Forest and Range Experimental Station, Seattle, Wash., Jun. 1, 1983; pp. i-iii and 1-87.

(7) Schiess, P., and K. Yonaka; Evaluation of industrial baling techniques for forest residue; Final Report to Department of Natural Resources, Olympia, Wash., Jun. 30, 1983; pp. i-iv and 1-67.

(8) Guimier, D. Y. 1985. Evaluation of forest biomass compaction systems. Special Report No. SR-30. ENFOR Project P-313. Pointe Claire, Canada: Forest Engineering Research Institute of Canada.

(9) Pottie, M. A., and D. L. Guimier, Harvesting and transport of logging residuals and residues, FERIC Special Report No. SR-33, IEA Cooperative Project No. CPC6, pp. i-vii and 1-62, May 1986.

(10) U.S. Pat. No. 3,827,353 entitled CHRISTMAS TREE BALING MACHINE; U.S. Pat. No. 3,911,519 entitled LEAF COLLECTOR AND BALER; U.S. Pat. No. 4,377,362 entitled DEVICE FOR BUNDLING FIREWOOD; U.S. Pat. No. 4,463,667 entitled LOG BUNDLING APPARATUS; U.S. Pat. No. 4,467,712 entitled WOOD BALER; U.S. Pat. No. 4,572,064 entitled BRUSH BUNDLING SYSTEM; U.S. Pat. No. 4,991,498 entitled LEAF BALER; U.S. Pat. No. 5,243,901 entitled FIREWOOD BANDING MACHINE; U.S. Pat. No. 6,189,443 B1 entitled PRUNING BALER; U.S. Pat. No. 6,427,585 B1 entitled METHOD AND APPARATUS FOR MEASURING THE LENGTH OF A WASTE LOG AND/OR WEIGHT OF WASTE LOG WHILE COMPACTING AND TRANSFERRING THE WASTE LOG FOR TRANSPORT; U.S. Pat. No. 6,779,570 B2 entitled WOOD GATHERING AND COMPACTION VEHICLE; U.S. Pat. No. 6,820,542 B1 entitled LEAF COMPACTOR AND BALER; US 2005/0132667 A1 entitled COLLECTION AND STACKING OF LUMBER PIECES FROM THE GROUND; US 2006/0086419 A1 entitled MOBILE HIGH-SPEED BIOMASS PROCESSOR FOR CHUNKWOOD WITH INTEGRAL CHUNKWOOD BALER; US 2007/0157825 A1 entitled FOLIAGE COMPACTOR; WO 2007/138165 A1 entitled METHOD AND ARRANGEMENT FOR HARVESTING; and particularly US 2005/0145115 A1 entitled MACHINE FOR THE RECOVERY OF FOREST, AGRICULTURAL AND/OR URBAN WASTE.

(11) www.deere.com/en_US/cfd/forestry/deere_forestry/harvesters/wheel/1490d_general.html Accessed 23 Feb. 2009.

(12) https://www.timberbuysell.com/Community/DisplayAd.asp?id=2686

Accessed 7 Nov. 2008; see also US 2009/0007537 entitled DEVICE AND METHOD FOR HARVESTING WOODY CROPS.

(13) WO 03/031167 A1 entitled OPEN TOP FINGER BALER; WO 99/37474 entitled IMPROVED BALING PRESS; and WO 89/10836 entitled BALING PRESS.

(14) Dooley, J. H., M. S. DeTray, and D. N. Lanning. March 2006. Technology to enable utilization of biomass from wildland-urban interface fuels reduction projects. Phase II: Field evaluation of baling vs. chipping. Auburn, Wash.: Forest Concepts, LLC.

(15) Dooley, J. H., M. S. DeTray, D. N. Lanning, J. L. Fridley; Utilization of biomass from WUI fuels reduction: Biomass collection and handling from wildland-urban intermix projects on residential and suburban properties; Poster presented at SmallWood 2006, Richmond, Va., May 16, 2006.

(16) Dooley, J. H., J. L. Fridley, D. N. Lanning. M. S. DeTray; Large rectangular bales for woody biomass; Paper No. 068054, presented at the 2007 ASABE Annual International Meeting, Portland, Oreg., Jul. 9-12, 2006.

(17) Dooley, J. H., D. N. Lanning, C. Lanning, and M. S. DeTray; Transportation of biomass from wildland urban intermix (WUI): Biomass preprocessing and handling to reduce cost of transportation and add value; poster presented at Intermountain Roundwood Association Annual Meeting, Missoula, Mont., 2007.

(18) Lanning, D. N., J. H. Dooley, M. C. DeTray, and C. J. Lanning; Engineering factors for biomass baler design; ASABE Paper No. 078047, presented at the 2007 ASABE Annual International Meeting, Minneapolis, Minn., Jun. 17-20, 2007.

(19) Lanning, D., C. Lanning, J. Dooley, M. DeTray, T. Aristidou; Baling to improve transport of biomass from urban areas; poster presented at the Forest Innovation Conference, Missoula, Mont., Apr. 25, 2008.

(20) Dooley, J. H., D. Lanning, C. Lanning, J. Fridley; Biomass baling into large square bales for efficient transport, storage, and handling; paper presented at the Council on Forest Engineering 2008: 31st Annual Meeting, Charleston, S.C., Jun. 22-25, 2008.

While the preferred embodiment of the invention has been illustrated and described, it will be appreciated that various changes can be made therein without departing from the spirit and scope of the invention.

We claim:

1. A baler for making compacted bales of a woody biomass material, the baler comprising: a housing defining a compaction chamber therein, wherein the housing comprises a top wall, an infeed opening defined in the top wall for introducing the material into the compaction chamber, and a hopper system comprising: first and second doors pivotally attached to the housing in opposing array over the infeed opening, wherein each door comprises a pivot having a plurality of fingers extending in planar array therefrom and defining a plurality of recesses disposed therebetween, wherein the fingers of the first and second doors are staggered such that the fingers of each door are positioned opposite to and receivable by the recesses of the other door, and actuator means for pivoting the doors upwardly to form a chute for directing the material toward the infeed opening, and downwardly to intermesh the fingers and substantially cover the infeed opening, and wherein a cutting device is mounted on the housing alongside the infeed opening.

* * * * *